US005724738A

United States Patent [19]

Ballarini

[11] Patent Number: 5,724,738

[45] Date of Patent: Mar. 10, 1998

[54] ENVELOPE OPENER WITH DISPOSABLE BLADE

[76] Inventor: Franco Ballarini, 2132 W. 62 St., Hialeah, Fla. 33016

[21] Appl. No.: 764,388

[22] Filed: Dec. 13, 1996

[51] Int. Cl.[6] ..... B26B 29/00

[52] U.S. Cl. ..... 30/294; 30/DIG. 3; D8/102

[58] Field of Search ..... 30/286, 289, 293, 30/294, 329, 335, 337, 339, DIG. 3; D8/102

[56] References Cited

U.S. PATENT DOCUMENTS

| | | | |
|---|---|---|---|
| 2,242,936 | 5/1941 | Beaver | 30/335 |
| 2,610,399 | 9/1952 | Adams et al. | 30/294 |
| 2,624,116 | 1/1953 | Steinke | 30/339 |
| 3,009,248 | 11/1961 | Tilly | 30/294 |
| 3,028,670 | 4/1962 | Tilly | 30/294 |
| 3,290,780 | 12/1966 | Oehlert | 30/294 |
| 3,824,688 | 7/1974 | Goffe | 30/294 |
| 5,285,577 | 2/1994 | Carney et al. | 30/294 |
| 5,561,905 | 10/1996 | Sherman | 30/280 |

*Primary Examiner*—Hwei-Siu Payer
*Attorney, Agent, or Firm*—J. Sanchelima

[57] ABSTRACT

An opener for envelopes that includes a flat member with a straight slot that defines a pointed portion to facilitate its insertion between the flap and the rest of the envelope. A bay at the end of the slot coincides with the cutout of a removable blade kit that is received within a channel that runs at an angle with respect to the straight slot. A locking protuberance and a cooperating cavity are provided to keep the blade kit in place.

2 Claims, 1 Drawing Sheet

ENVELOPE OPENER WITH DISPOSABLE BLADE

BACKGROUND OF THE INVENTION

1. Field of the Invention

The present invention relates to an envelope opener, and more particularly, to the type that includes a disposable blade.

2. Description of the Related Art

There are many types of opener assemblies for paper envelopes nowadays. However, none of them teaches an opener that includes a disposable blade, so that the same opener can be used for longer period of time by replacing just the blade. Also, and more important, the use of a disposable blade facilitates the manufacturing process, so that can be easily assembled the different parts of the opener assembly in a considerable less time, thereby lowering the production cost while retaining its quality. On the other hand, in conventional manufacturing processes, it is necessary to set in the metallic blade in a specific position when the opener assembly is molding.

SUMMARY OF THE INVENTION

It is one of the main objects of the present invention to provide an envelope opener that has such a structure that permits a user to replace the blade.

It is another object of this invention to provide an envelope opener that permits a manufacturer to easily assemble the different parts of the opener assembly in a considerable less time, thereby lowering the production cost while retaining its quality.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
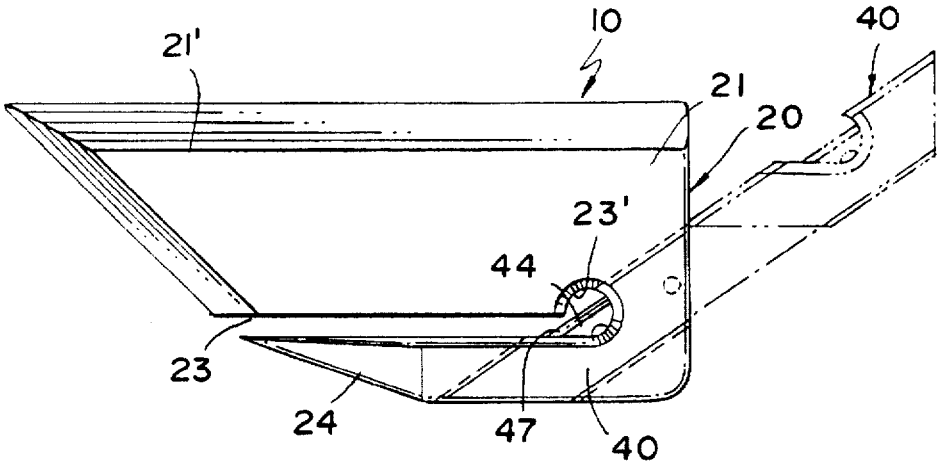
FIG. 1 is a top view of the present invention showing the blade kit in phantom when it is removed.
Figure 2:
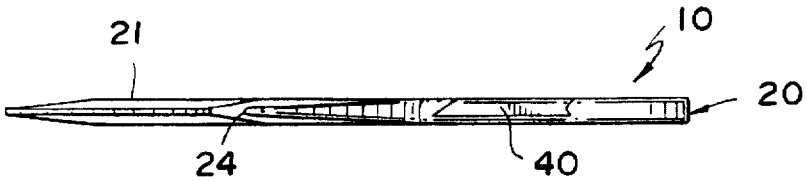
FIG. 2 is an elevational side view of this invention shown in the previous figure.
Figure 3:
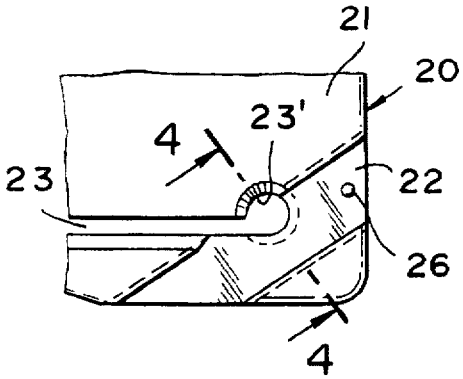
FIG. 3 is partial top view of this invention showing the receiving channel with the blade kit removed.

Referring now to the drawings, where the present invention is generally referred to with numeral 10, it can be observed that it basically includes opener body 20 and blade kit 40 slidably mounted therein.

Opener body 20, in the preferred embodiment, has flat member 21 with slanted edges 21' defining two sides. Opener body 20 also includes channel 22 that cooperatively and slidably receives blade kit 40. Opener body 20 also includes slot 23 with bay 23' and elongated pointed end 24 designed to be inserted between an envelop flap and the rest of the envelope (not shown). Channel 22 is positioned adjacent to bay 23' and disposed at an angle of inclination between 30 and 75 degrees with respect to slot 23. Body assembly 20 is then pushed towards the envelope causing blade member 44 to cut along the end of the envelope flap.

Figure 5:
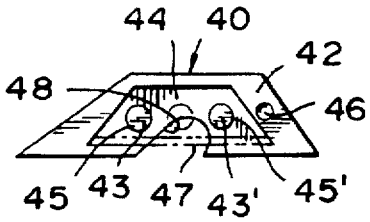
FIG. 5 is a top view of the blade kit.
Figure 4:
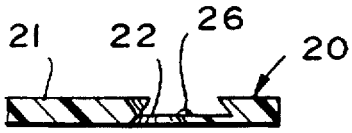
FIG. 4 is an elevational partial view of this invention, taken along line 4—4 in FIG. 3.

Blade kit 40, in the preferred embodiment, includes blade holder 42 and blade member 44, as best seen in FIG. 5. Blade holder 42 includes protuberances 43 and 43', cavity 46 and cutout 48. Cutout 48 has cooperative dimensions that permits its alignment with bay 23'. Blade holder 42 holds blade member 44 with protuberances 43 and 43' that are cooperatively and snugly received within openings 45 and 45' of blade member 44. Bay 48 exposes edge 47 of blade member 44.

As mentioned above, blade kit 40 is removably mounted to opener body 20 by sliding the former through channel 22. Channel 22, in the preferred embodiment, has protuberance 26 that is designed to receive cavity 46 of blade holder 42. In this manner, blade kit 40 is engaged by protuberance 26 when is received by cavity 46 of blade holder 42. Bay 23' of body 20 is aligned with respect to cutout 48 of blade kit 40, thereby leaving blade edge 47 exposed for cutting the paper envelope where the flap joins the rest of the envelope.

Having assembly 10 with two separate main parts, such as opener body 20 and blade kit 40, permits a manufacturer to produce them in different colors, that is another advantage of the disclosed invention. At present, the process for mounting a blade (typically metallic) is incompatible with the process for forming body 20, requiring a considerably amount of operation's time and skill.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An opener for envelopes comprising:

A) a flat member with a straight slot defining an elongated pointed position and said slot ending with a bay and said flat member including a channel positioned adjacent to said bay and disposed at an angle with respect to said slot, said angle being between 30 and 75 degrees; and B) curling means removably received within said channel and including cutting edge that is exposed within said bay wherein said cutting means includes a blade member and a cutout that exposes said cutting edge when aligned with said bay.

2. The opener set forth in claim 1 further including:

C) locking means for keeping said cutting means removably mounted within said channel.

* * * * *